United States Patent [19]

DeBoer, Jr. et al.

[11] 4,284,590

[45] Aug. 18, 1981

[54] MULTIPLE ASPIRATOR FOR NEBULIZER

[75] Inventors: Roy DeBoer, Jr., Lake in the Hills; Kenneth G. Miller, Palatine, both of Ill.

[73] Assignee: Respiratory Care, Inc., Arlington Heights, Ill.

[21] Appl. No.: 188,102

[22] Filed: Sep. 17, 1980

[51] Int. Cl.[3] ..... B01F 3/04

[52] U.S. Cl. ..... 261/62; 239/338; 239/424.5; 239/434; 261/78 A; 261/118

[58] Field of Search ..... 261/44 R, 62, 78 A, 261/118, DIG. 65; 239/338, 424.5, 434; 128/200.21

[56] References Cited

U.S. PATENT DOCUMENTS

| | | | |
|---|---|---|---|
| 1,269,122 | 6/1918 | Saile et al. | 239/338 X |
| 1,785,802 | 12/1930 | Adams | 239/434 |
| 2,967,327 | 1/1961 | Ladisch | 239/434 X |
| 3,134,827 | 5/1964 | Pontow et al. | 261/62 X |
| 3,524,630 | 8/1970 | Marion | 261/78 A X |
| 4,018,387 | 4/1977 | Erb et al. | 239/338 X |
| 4,073,832 | 2/1978 | McGann | 261/78 A X |

*Primary Examiner*—Richard L. Chiesa
*Attorney, Agent, or Firm*—Eric P. Schellin

[57] ABSTRACT

A multiple aspirator has a disk with an axial hole and a plurality of radial bores, providing liquid feeding channels, which end at the axial hole. A round rod is disposed coaxially in the axial hole. Gas flow parallel to the axis, through the hole past said disk, is forced by the rod into an annular pattern, thereby aspirating fluid from the radial bores and nebulizing it in said annular pattern.

8 Claims, 4 Drawing Figures

MULTIPLE ASPIRATOR FOR NEBULIZER

SUMMARY

Disclosed herein is a high volume aspirator for liquid nebulization which is adapted for economical production as a molded plastic product.

The high volume is obtained by operating a plurality of individual aspirators in multiple, whereby the combined volume aspirated is the sum of the individual contributions.

By arranging the individual aspirators radially about a longitudinal axis of symmetry, and having a stream of gas flow in an annular channel along and concentric to said axis, the fluid can be aspirated from the plurality of individual aspirators into the flowing gas, where it is nebulized.

The arrangement of parts is compact. Furthermore, it is economical in the use of gas to accomplish high volume aspiration, since the individual aspirator can be designed to be efficient. Finally, the shape of the few parts is such as to be adapted for mass production by plastic injection molding.

THE DRAWINGS

DETAILED DESCRIPTION

Figure 1:
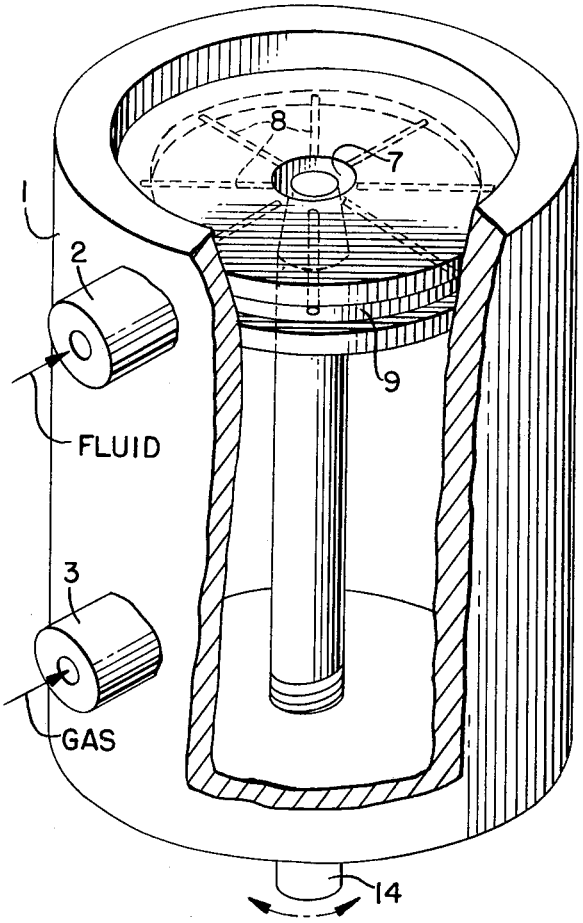
FIG. 1 is a partly exploded perspective view of the multiple aspirator.
Figure 2:
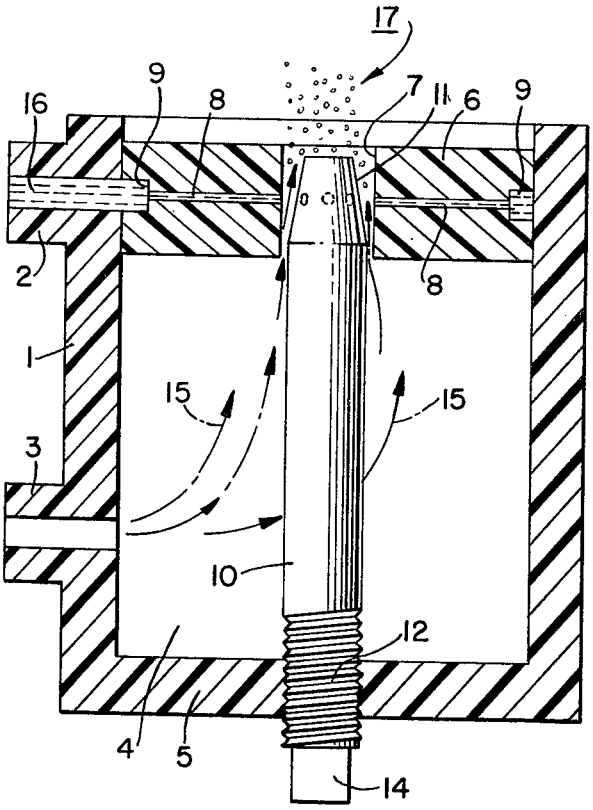
FIG. 2 is a longitudinal cross sectional view of the aspirator along the section lines 2—2 of FIG. 3.

The multiple aspirator, as illustrated in the drawings, consists of a cylindrical body 1 which has a fluid inlet 2 and a gas inlet 3. The cylindrical body has a concentric cavity 4 and integral end closure 5, as best seen in FIG. 2. The open end of the cavity 4 is partly closed by a disk shaped member 6, which is in fluid-tight contact at its outer periphery with the inner wall of the body 1. The disk shaped member has an axial aperture 7. A series of radial bores 8 extend from the axial aperture 7 to a concentric groove 9, situated in the outer periphery of the disk shaped member 6. The groove 9 is in fluid communication with fluid inlet 2, as is evident from the upper left portion of the cross sectional view of FIG. 2.

A round rod 10 having a tapered nose 1 is rotatable on its axis and on the screw threads 12, by means of adjusting knob 14, to variably protrude into the axial aperture 7. The rod 10 and tapered nose 11 at all times are concentric with the axial aperture, as the adjusting knob 14 is turned.

Gas inlet 3 is in pneumatic communication with cavity 4. When gas under pressure enters gas inlet 3, the gas enters cavity 4 as shown by the arrows 15 of FIG. 2, and exits from cavity 4 through the annular space between tapered nose 11 and the axial aperture 7. Since the nose 11 is tapered, as the adjustment of rod 10 is changed (by means of adjusting knob 14) the annular space between tapered nose 11 and the adjacent face of axial aperture 7 also varies. The resulting change in the pneumatic resistance of the said annular space to the flow of gas out of cavity 4 past the ends of radial bores 8 changes. With the change of pneumatic resistance, there is a change of velocity of flow adjacent said ends of the radial bores 8, and, because of the Bernoulli effect, a consequent change of pressure adjacent said ends. This results in varying amounts of fluid 16 being drawn out of the said ends of the radial bores 8 at different adjustments of the knob 14.

As the fluid 16 is drawn out of radial bores 8, the drop that forms at the end of each bore is under the forces of surface tension and the blast of the flowing gas. The drop vibrates fiercely and is torn apart to form part of the mist 17 which is carried along by the flowing gas. Thus the liquid 16 is nebulized.

The diverging expansion space between tapered nose 11 and the axial aperture acts as an accelerating means for the flowing gas, so that a given amount of gas is able to atomize, nebulize and transport a large amount of fluid in the form of a mist.

It will be noted that the construction is a simple assembly of only three parts. None of the parts are complex, and all can be made by injection molding plastic materials. Thus, the disclosed multiple aspirator is adapted for the mass-market production line.

In order to ensure that each of the radial bores 8 delivers the same amount of fluid to be nebulized, it is necessary to have the annular channel between the tapered nose 11 and the axial aperture 7 truly concentric and to have the dimensions of the concentric groove 9 so much larger than the diameter of the radial bores 8 that the water which is being aspirated experiences substantially no pressure drop while flowing in the concentric groove 9.

Figure 4:
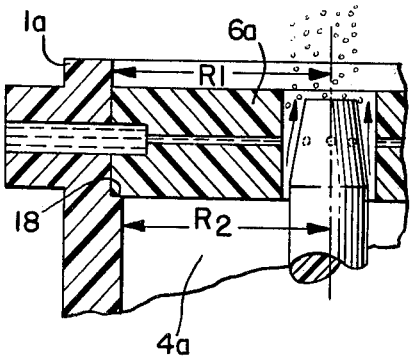
FIG. 4 is a sectional view of a portion of a modified embodiment of the aspirator.
Figure 3:
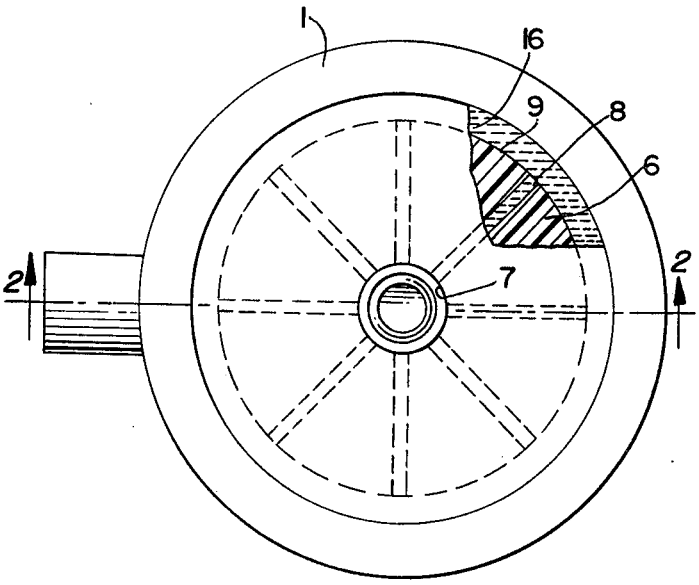
FIG. 3 is a top view of the aspirator.

In the construction of the multiple aspirator many obvious variations are possible. For example, for ease of assembly of the disk shaped member 6 with the cylindrical body 1, the modified embodiment of FIG. 4 might be utilized. Here the interior wall of the body 12 is made to have two radii, a lesser one of $R_2$ and a larger one of $R_1$, to provide a shoulder 18. When the disk shaped member 6*a* is pushed into the cavity 4*a*, the shoulder 18 will locate the disk shaped member at the correct height, with respect to fluid inlet 2, and also in a non-tilted attitude. Furthermore, the shoulder 18, for example, makes it easier to apply plastic solvent properly to the correct areas of the interior of the cavity 4*a* to cement the plastic disk shaped member 6*a* to the cylindrical body l*a*. It is to be noted that solvent tends to stick to and follow an interior angle, such as that provided by shoulder 18.

Another variation is to reduce considerably the space between end wall 5 and the disk shaped member 6. This might involve placing the fluid inlet 2 and gas inlet 3 at different orientations about the cylindrical body 1.

Other modifications will be evident to those skilled in the art.

What is claimed as the invention is:

1. A multiple aspirator comprising:

a disk shaped member having an axis, two faces spaced along said axis with each face perpendicular thereto, an outer peripheral edge concentric with said axis and an axial aperture, concentric with said axis, connecting one face with the other;

a plurality of bores in said disk-shaped member, said bores being radial to said axis and angularly disposed about said axis, said bores connecting said outer peripheral edge with said axial aperture;

means to force a stream of gas from one side of said disk shaped member to the other through said axial aperture;

a rod shaped member, concentric on said axis, located to restrict the axial aperture so that gas flow from one side of said disk shaped member to the other can take place only in the annular clearance between said rod and said axial aperture;

means to supply fluid to the outer peripheral edge of said disk shaped member;

whereby the flow of gas in said annular clearance causes fluid to be drawn through each of said bores to said annular space, whereat it is nebulized and transported;

whereby each of said bores constitutes part of a separate aspirator, individual to its bore, and whereby each of said separate aspirators operates independently of the other separate aspirators.

2. Subject matter under claim 1 in which:

the rod shaped member is tapered, whereby said annular clearance is tapered inversely; and the taper of said rod shaped member is such that its diameter decreases downstream of the gas flow;

whereby the cross sectional area of said annular clearance increases downstream of the gas flow.

3. Subject matter under claim 2 in which:

the rod shaped member is adjustable longitudinally along said axis, whereby the aspirating action can be adjusted.

4. Subject matter under claim 3 in which:

the cylindrical surface of said rod shaped member is threaded to provide a male screw thread;

a nut to engage and support said thread;

means to adjustably rotate said rod shaped member while engaged and supported by said nut;

whereby said rod shaped member is longitudinally adjustable.

5. A multiple aspirator comprising:

a can-shaped member having a cylindrical wall and a closed bottom, and having a longitudinal axis of symmetry;

means to inject gas under pressure into the can shaped member through its cylindrical wall;

means to channel the injected gas as it leaves the can, said means to channel comprising a disk shaped member and a throttling rod;

said disk shaped member being symmetric about said longitudinal axis of symmetry and having a central aperture, with the edges of said disk shaped member in gas tight engagement with said cylindrical wall;

whereby the injected gas is channeled to leave the can shaped member by way of said central aperture;

said throttling rod being located to be symmetric about said axis of symmetry and concentric within said central aperture;

whereby the injected gas is further channeled to leave the can shaped member by way of an annular space between said central aperture and said throttling rod;

fluid tight channel means associated with the periphery of said disk-shaped means;

means to supply said channel means with fluid;

a plurality of bores in said disk shaped member connecting said channel means with the central aperture, said bores being radial of said axis of symmetry and being angularly spaced about said axis of symmetry;

whereby gas flowing in said annular space will aspirate fluid from said bores and nebulize and transport said fluid in said annular space.

6. Subject matter under claim 5 in which:

said throttling rod is tapered, whereby said annular space is tapered inversely; and the taper of said throttling rod is such that its diameter decreases downstream of the gas flow;

whereby the cross sectional area of said annular space increases downstream of the gas flow.

7. Subject matter under claim 6 in which the throttling rod is adjustable longitudinally along said axis, whereby the aspirating action can be adjusted.

8. Subject matter under claim 7 in which:

the cylindrical surface of said throttling rod is threaded to provide a male screw thread;

a nut to engage and support said thread;

means to adjustably rotate said throttling rod while engaged and supported by said nut;

whereby said throttling rod is longitudinally adjustable.

* * * * *